US006820834B1

(12) United States Patent
Niskanen

(10) Patent No.: US 6,820,834 B1
(45) Date of Patent: Nov. 23, 2004

(54) REEL UP

(75) Inventor: Heikki Niskanen, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/673,981

(22) PCT Filed: Apr. 21, 1999

(86) PCT No.: PCT/FI99/00321

§ 371 (c)(1),
(2), (4) Date: Oct. 23, 2000

(87) PCT Pub. No.: WO99/55608

PCT Pub. Date: Nov. 4, 1999

(30) Foreign Application Priority Data

Apr. 24, 1998 (FI) ..... 980908

(51) Int. Cl.[7] ..... B65H 18/20

(52) U.S. Cl. ..... 242/541.3; 242/542.3; 198/840; 474/246

(58) Field of Search ..... 242/541, 541.1, 242/541.3–541.4, 542.3–542.4, 547; 474/246; 198/840

(56) References Cited

U.S. PATENT DOCUMENTS

| | | | | | |
|---|---|---|---|---|---|
| 841,994 | A | * | 1/1907 | Mason | 242/542.4 |
| 2,777,644 | A | * | 1/1957 | Nicholson | 242/542.4 |
| 4,746,076 | A | | 5/1988 | Tomma et al. | 242/66 |
| 4,877,196 | A | | 10/1989 | Heymanns | 242/66 |
| 4,883,233 | A | | 11/1989 | Saukkonen et al. | 242/66 |
| 5,071,083 | A | * | 12/1991 | Tubota et al. | 226/193 |
| 5,531,396 | A | | 7/1996 | Kinnunen et al. | 242/526.3 |
| 5,553,806 | A | * | 9/1996 | Lucas | 242/542.4 |
| 5,593,106 | A | * | 1/1997 | Cavanagh | 242/527 |
| 5,785,273 | A | | 7/1998 | Wolf et al. | 242/541.3 |

FOREIGN PATENT DOCUMENTS

| | | |
|---|---|---|
| DE | 498962 | 5/1930 |
| DE | 3816777 | 12/1988 |
| DE | 19505870 | 8/1996 |
| EP | 0658504 | 6/1995 |
| FI | 74260 | 9/1987 |
| FI | 90853 | 12/1993 |
| FI | 94231 | 4/1995 |

* cited by examiner

*Primary Examiner*—Kathy Matecki
*Assistant Examiner*—Sang Kim
(74) *Attorney, Agent, or Firm*—Steinberg & Raskin, P.C.

(57) ABSTRACT

A reel-up/winder, comprising one or several members (11, 12) that support the reel/roll (10) to be formed onto a reel/roll spool (16), of which members at least one support member is a belt support member (12), which consists of a belt loop (15) which is supported by means of at least two rolls (13, 14), whose axes are substantially parallel to the axis of the reel/roll spool (16). Into the outer face of the mantle of at least one roll (13, 14) in said belt support member (12), a substantially spiral-shaped groove (204) has been formed, which extends across the axial width (1) of the roll mantle (202).

19 Claims, 3 Drawing Sheets

Prior Art

REEL UP

FIELD OF THE INVENTION

The present invention relates to a reel-up/winder and in particular a reel/up winder for use in a paper/board machine.

BACKGROUND OF THE INVENTION

In reeling or winding of paper or of a corresponding web-like material, commonly a drum winder or a what is called Pope-type reel-up is used. In a drum winder, there are two winding drums, on which the paper roll is formed. The paper roll that is being formed is loaded by means of a rider roll, which is fitted in contact with the top face of the paper roll. From a drum winder, further a winder with a set of belt rolls has been developed, in which one of the winding drums has been substituted for by an arrangement of a support belt. In a Pope-type reel-up, the reel is formed by means of a reel cylinder so that the web is passed through the nip formed between the reel cylinder and the reel spool onto the reel spool.

In the applicant's FI Patent No. 74,260 (equivalent U.S. Pat. No. 4,801,758), an example is described of a winder with a set of belt rolls placed after a slitter. The device comprises support members for supporting the roll that is being formed at least primarily by means of circumferential support and loading members for keeping the roll against the support members. The support members comprise a winding drum and a mobile support-web member, which supports the roll that is being formed over a considerable length of the circumference. Loading members press the roll against the winding drum and/or against the rigidly or displaceably supported support member of said support-belt member. The support-belt arrangement comprises a frame, to which two support rolls, an alignment roll and a tensioning roll have been attached. On the rolls, an endless support belt is supported, which can also be composed of a number of belts fitted side by side. The roll that is being formed is supported by means of the winding drum as well as by means of the portion of the support belt placed between the support rolls. One of the support rolls and the tensioning roll have been attached to the frame by means of an articulated arm, in which connection the position of the support bell in relation to the roll that is being formed can be regulated.

In the applicant's FI Patent No. 94,231 (equivalent U.S. Pat. No. 5,531,396), an example is described of a Pope-type reel-up for a machine-width web, which device makes use of a support belt. The reel-up comprises a reel cylinder and a first reel spool, which is in nip contact with the reel cylinder when the web is reeled through the nip onto the first reel spool, and the reel-up comprises a transfer device for the transfer of an empty second reel spool into nip contact with the reel cylinder when the first reel is complete. The reel-up also comprises a belt for supporting the web and for passing the web over the reel cylinder as well as a displaceable belt alignment roll, which has been arranged inside the bell loop and which can be transferred into nip contact with the reel placed on the first reel spool. The reel-up further comprises devices for the transfer of said belt alignment roll and of said first reel, while in nip contact, into a change position so that the web is supported by means of said belt and that the web runs through a nip formed between the belt alignment roll and said first reel.

In the FI Patent 90,853 (Jagenberg Aktiengesellschaft), a loading roll for use in a reeling/winding device has been described, at which the outer face of the roll mantle is provided with a number of grooves extending across its entire width. Said grooves pass favourably as spiral-shaped at an angle of about 15° in relation to the longitudinal axis of the loading roll. Any air that has penetrated between the topmost web layer and the winding drum is carried in the grooves through the gap between the loading roll and the reel cylinder. In such a case, the air is distributed evenly, and no detrmental effects, such as folds, occur, In reeling and winding, air is carried along with the web, which air can form an air cushion in the gap between the reel cylinder and the web in the reeling/winding nip. In the outer face of the mantle of the reel cylinder, it is possible to use relatively narrow, steep and deep grooves parallel to the circumference of the mantle, by means of which grooves the air that is carried into the gap between the web and the reel cylinder can be passed through the nip. In this way, a situation is avoided in which the reel cylinder loses its contact with the web. Out of the gap between the web and the reel/roll that is being formed, air is also always carried along with the web through the reeling/winding nip. This air is carried between the outermost web layer and the reel/roll into the following reeling/winding nip, in which it can easily form an air bag ahead of said reeling/winding nip. In prior-art reeling/winding devices in which a set of belt rolls is used in order to support and/or to carry the reel/roll that is being formed, this air bag is eliminated by means of grooves that have been formed into the outer face of the belt of the set of belt rolls, by means of which grooves the air placed under the outermost web layer is allowed to be discharged through the nip and also to be guided in the axial direction of the roll out of the ends of the reel/roll. Since the belt is worn in operation and since the groove must operate in the same way during the entire service life of the belt, a relatively deep groove must be made into the belt face. This is why the service life of the belt becomes shorter and the noise level higher.

OBJECTS AND SUMMARY OF THE INVENTION

By means of the solution in accordance with the present invention, the air bag can be eliminated ahead of the nip of the set of belt rolls from between the outermost web layer and the reel/roll without necessity to make grooves into the outer face of the belt.

The invention is suitable for use in all such reeling or winding devices in which the roll/reel to be formed on a reel/roll spool is supported by means of at least one support device based on belt support. Of the rolls placed inside the belt loop, one or several can be provided with a groove arrangement in accordance with the invention. At least those rolls placed inside the belt loop which form a nip with the reel/roll to be formed onto a reel/roll spool should preferably be provided with a groove arrangement in accordance with the present invention.

When the grooves are made onto a belt roll that forms a nip in stead of being made onto the belt, the manufacture of the belt is simplified. The belt manufacturer does not need a great number of different tools for the manufacture of belts provided with different grooves. The same belt can be used on belt rolls provided with different groove patterns. A simpler belt also has the consequence that a greater number of manufacturers are willing to manufacture belts, in which case the buyer obtains the advantage of increased competition.

BRIEF DESCRIPTION OF THE DRAWINGS

The invention will be described in the following with reference to the figures in the accompanying drawings, the invention being, however, not supposed to be confined to the details of said illustrations alone.

DETAILED DESCRIPTION OF THE INVENTION

Figure 1:
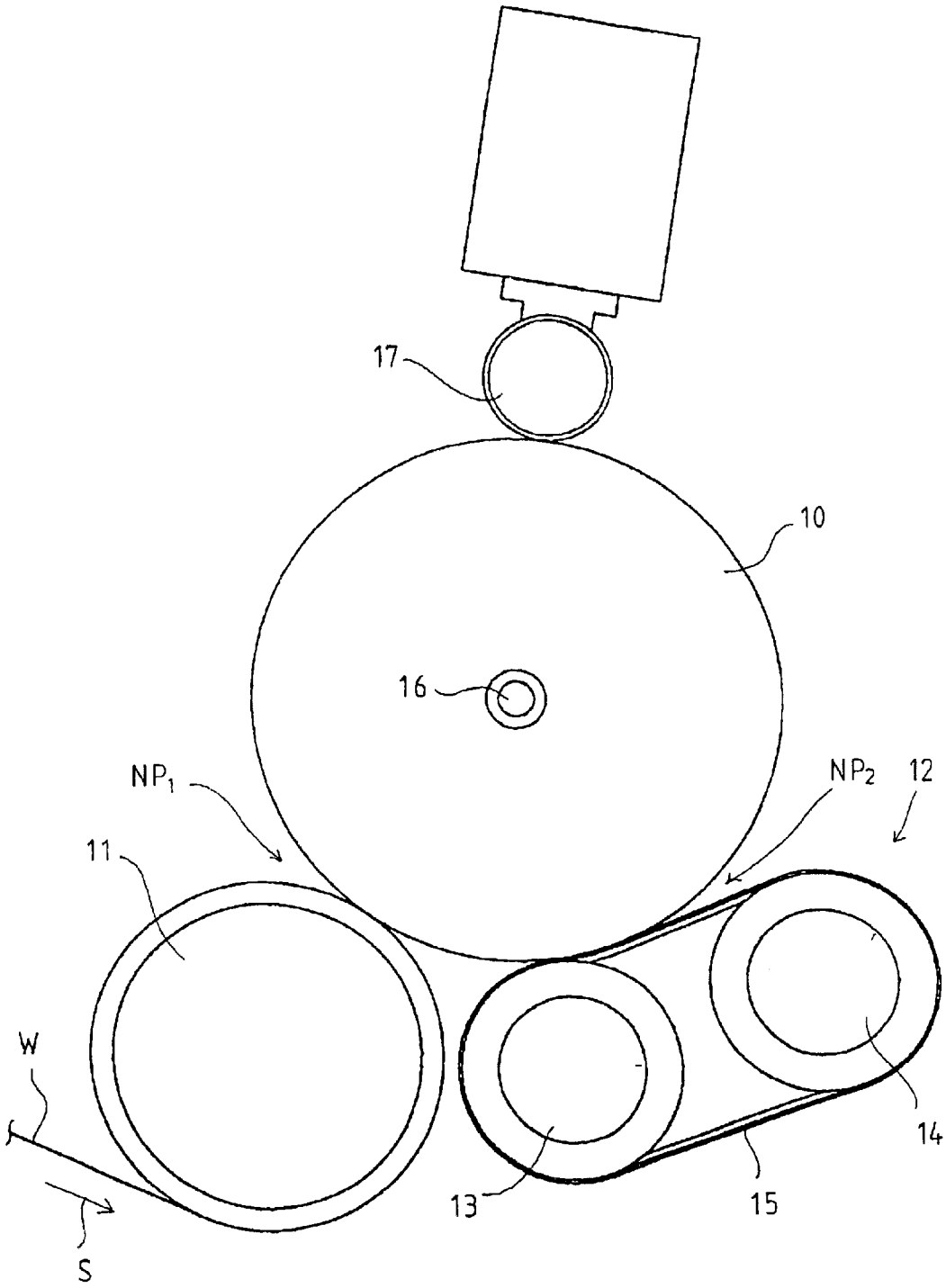
FIG. 1 is a schematic illustration of an exemplifying embodiment of a drum winder provided with a set of belt rolls, to which winder the solution in accordance with the present invention can be applied.

FIG. 1 shows a drum winder, in which a first winding drum 11 is shown, onto whose lower face the paper web W is introduced in the direction of the arrow S, and in which a second winding drum system 12 and a paper roll 10 to be formed on said drums are shown. The paper roll 10 is loaded with a rider roll 17. The second winding drum system 12 consists of a set of belt rolls, in which there are a first 13 and a second 14 belt roll, and of an endless belt 15 that surrounds said rolls. The belt 15 is favourably composed of at least two separate belts, which have been fitted side by side in the direction of the axes of the belt rolls 13, 14. By means of such a support by means of a set of belt rolls, a softer support of the paper roll 10 is obtained, in which case larger paper rolls can be formed without winding defects which arise from high nip loads. The paper web W runs through the first nip $NP_1$ between the first winding drum 11 and the paper roll 10 that is being formed and through the second nip $NP_2$ between the second winding drum system 12 and the paper roll 10 that is being formed and is wound onto the roll spool 16.

Along with the web W, air is carried through the first nip $NP_1$ into the gap between the web and the roll that is being formed. This air is carried further to ahead of the second nip $NP_2$, where the air present between the roll 10 and its outermost web layer forms an air bag in front of the second nip $NP_2$. This air bag causes defects in the roll 10, and therefore it is necessary to prevent formation of an air bag. In prior-art solutions, formation of an air bag is prevented so that grooves have been made into the outer face of the belt 15, by means of which grooves any air that has been packed under the outermost web layer in the roll 10 is allowed to pass through the second nip $NP_2$.

In the situation shown in FIG. 1, the belt 15 runs exclusively around two belt rolls 13,14, but the invention can, of course, also be applied in a situation in which the belt 15 has been passed to run on support of several rolls, as is the case, for example, in the applicant's said FI Patent 74,260.

Figure 2:
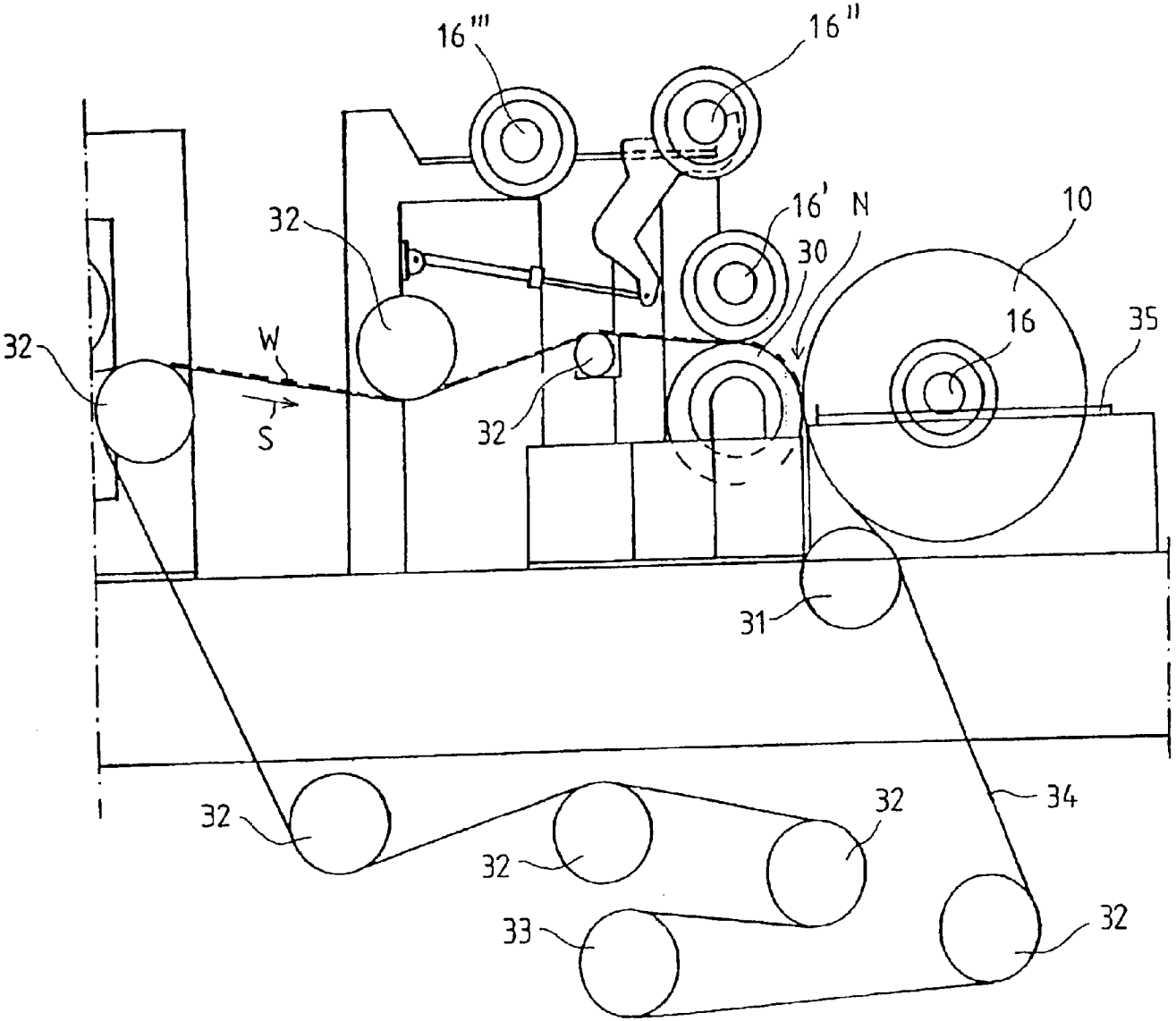
FIG. 2 illustrates an exemplifying embodiment of a Pope-type reel-up for a machine-width web which makes use of a support belt, to which device the solution in accordance with the present invention can also be applied.

FIG. 2 shows a Pope-type reel-up in accordance with the applicant's said FI Patent No. 94,231. This reel-up will be described herein exclusively in respect of the parts that are related to the present invention. The main part of the reel-up consists of a reel cylinder 30, along with whose circumference the web W runs before it is transferred onto the circumference of the reel 10 that is being formed around the reel spool 16. The reel spool 16 rests and revolves in a reeling position, for example, on support of two support rails 35. The reel-up further comprises a belt 34, which runs as guided by guide rolls 31,32,33 and through the nip N between the reel cylinder 30 and the reel 10. The belt 34 supports the web W when the web arrives in the reel-up and until the web W is wound around the reel 10 that is formed on the reel spool 16. The belt 34 extends in the cross direction of the machine substantially across the entire width of the machine. The running direction of the web W and of the belt 34 is denoted with the arrow S, and empty reel spools placed in a stand-by position are denoted with the reference numerals 16',16",16'".

The belt 34 can be tensioned by means of a guide roll 33 moving substantially in a horizontal plane, and the guide roll 31 can also be shifted to the right in a substantially horizontal plane. In a situation of change of reel spool 16, a new reel spool 16' is first transferred into nip contact with the reel cylinder 30. After this, the guide roll 31 is transferred into nip contact with the reel 10, after which the reel 10 and the guide roll 31 are transferred, while the nip contact between them is maintained, along the support rails 35, to the right in the figure, into the change position. After this the new reel spool 16' is transferred, while the nip contact with the reel cylinder 30 is maintained, onto the rails 35 to the reeling position, after which the web W is cut off and transferred so that it is reeled around the new reel spool 16'.

Also in this Pope-type reel-up, in which the reel 10 is supported by means of a belt 34 between the reel cylinder 30 and a guide roll 31, the problem mentioned above occurs. Along with the web W, air is carried through the nip N between the reel cylinder 30 and the reel 10 in between the outermost web layer and the reel. This air is carried between the outermost web layer and the reel 10 again to ahead of the nip N between the reel cylinder 30 and the reel 10, where the air forms an air bag.

Figure 3:
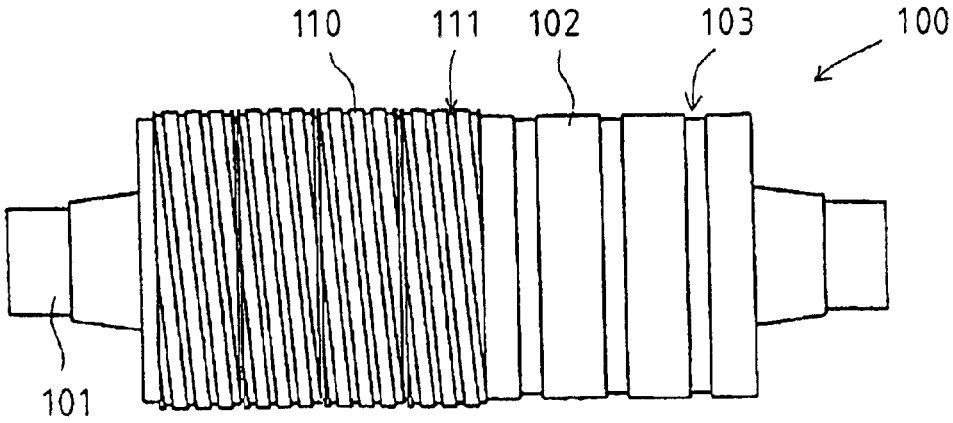
FIG. 3 shows a prior-art roll construction for use in a reeling/winding device that makes use of a belt support.

FIG. 3 illustrates a prior-art roll 100 for use in a reeling or winding device that makes use of belt support, which roll 100 is composed of an axle 101 and of a roll mantle 102. On the roll mantle 102, there are relatively deep guide grooves 103 parallel to the circumference of the roll mantle 102. In the figure, on the left half of the roll mantle 102, four belts 110 are illustrated, on whose outer faces there are prior-art grooves 111. On the inner faces of the belts 110, there are projections fitting into the guide grooves 103 on the roll mantle, in which way movement of the belts 110 on the face of the belt roll 100 parallel to the axle 101 of the belt roll 100 is prevented.

Figure 4:
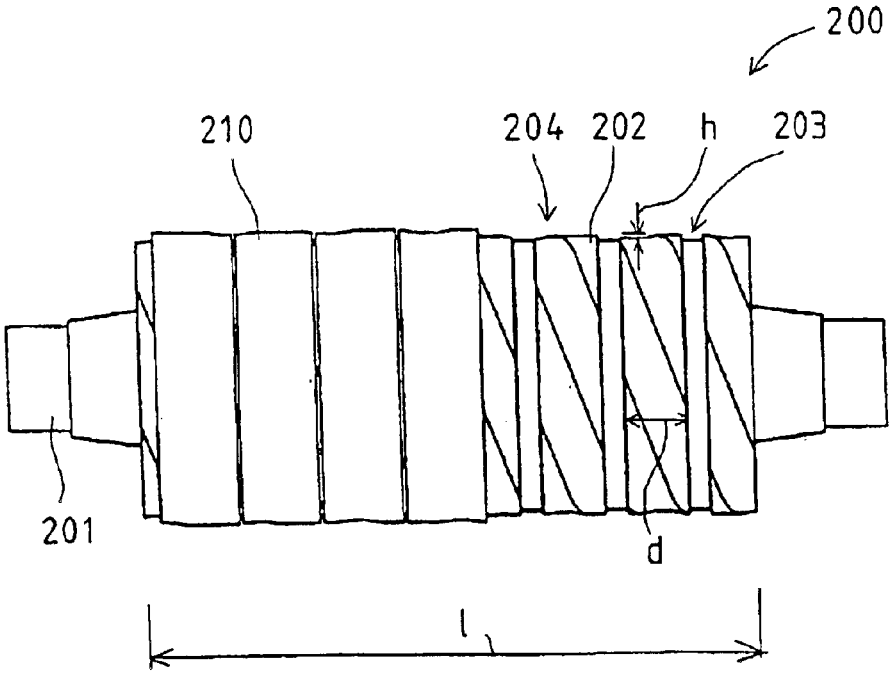
FIG. 4 shows a roll construction in accordance with the present invention for use in a reeling/winding device that makes use of a belt support.

FIG. 4 is a corresponding illustration of a roll 200 in accordance with the present invention for use in a reeling or winding device that makes use of belt support, which roll 200 consists of an axle 201 and of a roll mantle 202. Also in this solution, in the roll mantle 202, there are relatively deep guide grooves 203 parallel to the circumference of the roll mantle 202, into which grooves the projections provided on the inner face of the belt 210 are fitted. Also in this figure, on the left half of the roll mantle 202, four belts 210 are illustrated.

In the roll mantle 202 of the roll 200 in accordance with the invention shown in FIG. 4, there is also a second groove 204, which runs around the roll mantle 202 substantially in spiral form and which extends across the axial 201 width l of the roll 200. The depth h of this groove 204 is about 0.3 . . . 1.5 mm, preferably about 0.3 . . . 1.0 mm, and its width d is about 20 . . . 150 mm, preferably about 35 . . . 100 mm. The groove 204 must be relatively wide in order that the inner face of the belt 210 should be pressed into said groove 204 during running. The tension of the belt 210 is, during operation, about 20 . . . 25 kN/m (kilonewton per meter), and, as the inner face of the belt 210 is pressed into said groove 204 during running, a similar groove is "copied" in the outer face of the belt 15. This groove that has been "copied" in the outer face of the belt 204 operates as an air channel in the nip between the roll 200 and the reel/roll 10 that is being formed, along which channel the air that has arrived in front of the nip and that has been gathered between the reel 10 and its outermost web layer can be discharged through the nip, and also in the axial 201 direction of the roll 200 out of the ends of the reel/roll 10. For this second groove 204 the name vent groove is used. The cross-sectional form of the groove 204 can be, for example, a gentle arc, but since the width-to-depth ratio of the groove 204 is relatively large, all groove forms in which there are no sharp edges which abrade the belt 210 operate here well.

With this arrangement, no separate groove 111 is needed which is machined into the outer face of the belt 110 in a set of belt rolls. Thus, in a solution in accordance with the present invention, it is possible to use a standard belt 210 with a smooth outer face. The service life of a smooth standard belt 210, as compared with a grooved belt 110, is longer. The spiral-shaped vent groove 204 on the roll 200 mantle 202 has not been synchronized in relation to the length of the belt 210, in which way uniform wear of the belt 210 is guaranteed.

In the following, the patent claims will be given, and the details of the invention can show variation within the scope of the inventive idea defined in said claims and differ from what has been stated above by way of example only.

What is claimed is:

1. A reel-up/winder, comprising at least one support member (11,12; 30 . . . 34) that supports the reel/roll (10) to be formed onto a reel/roll spool (16), of which at least one of said support members has a set of belt rolls (12;30 . . . 34), which consists of a belt loop (15,34) and is supported by means of at least two rolls (13,14;30,31), whose axes are substantially parallel to the axis of the reel/roll spool (16), wherein into the outer face of a mantle of at least one roll (13,14;30,31) which is in nip contact with the reel/roll (10) to be formed in said set of belt rolls (12;30 . . . 34), a substantially spiral-shaped groove pattern (204) is formed between a plurality of guide grooves (203), which are formed in the mantle, said spiral-shaped groove pattern (204) and said plurality of guide grooves being spaced across at least a portion of the axial width (1) of the roll mantle (202).

2. A reel-up/winder as claimed in claim 1, wherein said support member is a first winding drum (11) and said set of belt rolls is a second winding drum arrangement (12) having a first belt roll (13), of a second belt roll (14), and adjacent endless belts (15) fitted around said first and second belt rolls, wherein a web (W), runs through a first nip ($NP_1$) formed between the first winding drum (11) and a paper roll (10) and through a second nip ($NP_2$) formed between the second winding drum arrangement (12) and the paper roll (10), wherein said web (W) is wound onto a roll spool (16), and wherein an outer face of a roll mantle (202) of the first belt roll (13) is in nip contact with the paper roll (10) formed in the second winding drum arrangement (12).

3. A reel-up/winder as claimed in claim 1, wherein a web (W) runs along a circumference of said reel cylinder (30) before it is transferred, through a nip (N) formed by the reel cylinder (30) and by a reel spool (16), which rests on support rails (35), onto a circumference of the reel (10) that is formed around the reel spool (16), and which reel-up further comprises an endless belt (34), which runs as guided by guide rolls (31 . . . 33) and through the nip (N) between the reel cylinder (30) and the reel (10), said belt (34) supporting the web (W) when the web (W) arrives in the reel-up and until the web (W) is reeled around the reel (10) that is formed onto the reel spool (16).

4. A reel-up/winder as claimed in claim 1, wherein said spiral-shaped groove (204) has a depth (h), at its deepest point, about 0.3 mm to about 1.5 nm.

5. A reel-up/winder as claimed in claim 1, wherein said spiral-shaped groove (204) has a width (d) about 20 mm to about 150 mm.

6. A reel-up/winder as claimed in claim 1, wherein said spiral-shaped groove (204) has a depth (h) at its deepest point about 0.3 mm to about 1.0 mm.

7. A reel-up/winder as claimed in claim 1, wherein said spiral-shaped groove (204) has a width (d) about 35 mm to about 100 mm.

8. A reel up/winder comprising:

a reel spool for forming a roll, said reel spool having an axis;

a support assembly comprising at least a first roll, at least a second roll and a belt arranged around said at least a first roll and said at least a second roll, wherein said at least first roll and said at least second roll each have an axis substantially parallel to said axis of said reel spool and wherein one of said at least a first roll and said at least a second roll has a substantially spiral-shaped groove pattern (204) formed on an outer surface of said roll and disposed between a plurality of guide grooves (203) said spiral-shaped groove pattern (204) and said guide grooves extending along at least a portion of the axial width of said roll.

9. The reel up/winder according to claim 8, further comprising a first winding drum and a paper web, wherein said first winding drum is arranged such that said paper web runs through a first nip defined by said first winding drum and said reel and then through a second nip defined by said at least first roll of said support assembly.

10. The reel up/winder according to claim 9, further comprising a reel cylinder arranged before said reel spool in a direction of travel of said web.

11. The reel up/winder according to claim 8, wherein said spiral-shaped groove (204) has a depth about 0.3 to about 1.5 mm.

12. The reel up/winder according to claim 11, wherein said spiral-shaped groove (204) has a depth about 0.3 to about 1.0 mm.

13. The reel up/winder according to claim 8, wherein said spiral-shaped groove (204) has a width about 20 to about 150 mm.

14. The reel up/winder according to claim 13, said spiral-shape groove (204) has a width about 35 to about 100 mm.

15. A reel up/winder comprising:

a reel spool for forming a roll, said reel spool having an axis;

a reel cylinder arranged before said reel spool in a direction of travel of a web;

an endless belt arranged around a plurality of guide rolls and said reel cylinder, said endless belt structured and arranged to guide said web through a nip defined between said reel cylinder and said reel spool;

wherein an outer face of a mantle of said reel cylinder has a substantially spiral shaped groove formed therein, and disposed between a plurality of guide grooves (203), said spiral-shaped groove and said plurality of guide grooves extending across at least a portion of the axial width of said reel cylinder.

16. The reel up/winder according to claim 15, wherein said spiral-shaped groove (204) has a depth about 0.3 to about 1.5 mm.

17. The reel up/winder according to claim 16, wherein said spiral-shaped groove (204) has a depth about 0.3 to about 1.0 mm.

18. The reel up/winder according to claim 15, wherein said spiral-shaped groove (204) has a width about 20 to about 150 mm.

19. The reel up/winder according to claim 18, said spiral-shaped groove (204) has a width about 35 to about 100 mm.

* * * * *

UNITED STATES PATENT AND TRADEMARK OFFICE

CERTIFICATE OF CORRECTION

PATENT NO. : 6,820,834 B1
DATED : November 23, 2004
INVENTOR(S) : Niskanen

It is certified that error appears in the above-identified patent and that said Letters Patent is hereby corrected as shown below:

Title page,
Item [54], Title, should read -- REEL-UP --

Signed and Sealed this

Seventeenth Day of May, 2005

JON W. DUDAS
*Director of the United States Patent and Trademark Office*